US010987952B1

(12) United States Patent
Terrero et al.

(10) Patent No.: US 10,987,952 B1
(45) Date of Patent: Apr. 27, 2021

(54) CHAMBERED VACUUM TRANSPORT PLATEN ENABLED BY HONEYCOMB CORE

(71) Applicant: Xerox Corporation, Norwalk, CT (US)

(72) Inventors: Carlos M. Terrero, Ontario, NY (US); Brian J. Dunham, Webster, NY (US); James J. Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 5 days.

(21) Appl. No.: 16/691,042

(22) Filed: Nov. 21, 2019

(51) Int. Cl.
*B41J 11/00* (2006.01)
*B41J 11/06* (2006.01)

(52) U.S. Cl.
CPC ..... *B41J 11/0085* (2013.01); *B41J 11/06* (2013.01)

(58) Field of Classification Search
CPC ..... B41J 11/0085; B41J 11/06
See application file for complete search history.

(56) References Cited

U.S. PATENT DOCUMENTS 4,540,990 A 9/1985 Crean
8,408,539 B2 4/2013 Moore
9,403,380 B2 8/2016 Terrero et al.
10,160,323 B2 12/2018 Griffin et al.
2007/0070099 A1 3/2007 Beer et al.
2011/0193921 A1* 8/2011 Chung ..... B41J 11/0085 347/104
2011/0292145 A1* 12/2011 Hoover ..... B41J 11/06 347/104
2013/0162742 A1* 6/2013 Inoue ..... B41J 13/226 347/104
2017/0239959 A1 8/2017 Sanchis Estruch et al.

FOREIGN PATENT DOCUMENTS

EP 1726446 A1 11/2006

OTHER PUBLICATIONS

U.S. Appl. No. 16/506,134, filed Jul. 9, 2019, Terrero et al.

* cited by examiner

*Primary Examiner* — Yaovi M Ameh
(74) *Attorney, Agent, or Firm* — Fay Sharpe LLP

(57) ABSTRACT

Disclosed is a media transport system utilizing a chambered honeycomb core platen for transporting and maintaining the flatness of a sheet of media in an associated printing system. According to one exemplary embodiment, the chambered honeycomb platen includes a plurality of rows of cross-drilled hollow columnar cells configured to independently communicate vacuum through the platen.

19 Claims, 11 Drawing Sheets

CHAMBERED VACUUM TRANSPORT PLATEN ENABLED BY HONEYCOMB CORE

BACKGROUND

The present disclosure is directed to a printing press substrate transport system used to transport and secure substrates while forming images on an imaging surface. More particularly, the present disclosure is directed to chambered vacuum platens with a honeycomb core that transport, secure, and maintain a large substrate flat under a printhead.

Conventional ink-jet printing systems use various methods to cause ink droplets to be directed towards a recording media. Well-known ink-jet printing devices include thermal, piezoelectric, and acoustic inkjet printhead technologies. All of these inkjet technologies produce roughly spherical ink droplets having a 15-100 μm diameter directed toward recording media at approximately 4 meters per second. Located within these printheads are ejecting transducers or actuators, which produce the ink droplets. These transducers are typically controlled by a printer controller or conventional minicomputer, such as a microprocessor.

A typical printer controller will activate a plurality of transducers or actuators in relation to movement of a recording media relative to an associated plurality of printheads. By controlling the activation of transducers or actuators and the recording media movement, a printer controller should theoretically cause the ink droplets produced to impact the recording media in a predetermined way, for the purpose of forming a desired or preselected image on the recording media. An ideal droplet-on-demand type printhead will produce ink droplets precisely directed toward the recording media, generally in a direction perpendicular thereto.

Further, for inkjet systems, the distance the ink droplet travels (i.e., drop flight distance) is influenced by many factors, including but not limited to: the printhead gap to the recording media; the jetting velocity; the printhead flight path; the variation in inkjet velocities across an array; nozzle straightness, flatness of the vacuum platen; transport motion of the recording media; air turbulence; printhead perpendicularity and alignment; timing errors; and nozzle pitch variation.

In certain inkjet systems, recording media sheets are usually transported under the printheads by a conveyor belt system. The conveyor belt system moves the media sheet and maintains the media flat under a printhead gap of less than 1 mm. The transport system may be a vacuum system including a perforated belt that is driven over a vacuum platen. A vacuum is pulled through the perforated belt and platen by a vacuum system. The platen controls the flatness of the belt and therefore, the media, as it moves along a printing zone.

It is very challenging to maintain the flatness of a recording media cross a large print area. For example, larger recording media, such as B series paper sizes B1 (30 inches by 40 inches) and B2 (23.55 inches by 30 inches) require print-bars with multiple printheads to form a larger printing zone (i.e., marking zone). The platen must have a low coefficient of friction to reduce drag from the belt of the conveyor system and must be durable enough to meet the life-expectancy of typical printing systems. The replacement of a worn-out platen is costly and undesirable.

Furthermore, due to the small gap between the printhead and media substrate, the flatness of the conveyor transport is critical. Variation in the gap will lead to image quality disturbances due to the variation in the ink drop flight time, dispersion, and trajectory. A reduced gap may also lead to recording media sheets striking the print bar, resulting in printhead damage and paper jams.

Another critical factor in the advancement of vacuum conveyor transports of inkjet systems is air turbulence within the airflow between the printhead and the recording media that is created by the vacuum system. As the recording media moves along the transport conveyor, the airflow around the leading and trailing edges of the media alternates from being restricted to unrestricted, or vice versa. As a result of the air turbulence, the droplet trajectory is affected, which can cause print quality defects such as image blurring, particularly around the leading and trialing edges of the recording media.

U.S. patent application Ser. No. 16/506,134 titled "Honeycomb Core Platen for Media Transport", incorporated by reference herein, describes a printing press substrate transport system to transport and secure substrates while forming images on an imaging surface incorporating a honeycomb platen system.

This disclosure provides a printing transport system which solves or avoids most if not all of the problems experienced in the prior art, many of those problems having been briefly discussed above, but also to design an inkjet printing system which solves or avoids most problems arising from present advances in inkjet printing technology.

INCORPORATION BY REFERENCE

U.S. Pat. No. 9,403,380, issued Aug. 2, 2016, by Terrero et al. and entitled "Media Height Detection System for a Printing Apparatus";

U.S. Pat. No. 10,160,323, issued Dec. 25, 2018, by Griffin et al. and entitled "Ink-jet Printing Systems";

U.S. Pat. No. 8,408,539, issued Apr. 2, 2013, by Moore and entitled "Sheet Transport and Hold Down Apparatus";

U.S. Pat. No. 4,540,990, issued Sep. 10, 1985, by Crean and entitled "Ink Jet Printed with Droplet Throw Distance Correction";

U.S. Patent Publication No. 2007/0070099, published Mar. 29, 2007, by Beer et al. and entitled "Methods and Apparatus for Inkjet Printing on Non-planar Substrates";

U.S. Patent Publication No. 2017/0239959, published Aug. 24, 2017, by Sanchis Estruch et al. and entitled "Print Zone Assembly, Print Patent Device, and Large Format Printer";

European Patent No. EP 1726446, publication date Nov. 29, 2006, by Thieme GmbH & Co. KG and entitled "Printing Table for a Flat-Bed Printing Machine"; and U.S. patent application Ser. No. 16/506,134 titled "Honeycomb Core Platen for Media Transport", filed Jul. 9, 2019, are incorporated herein by reference in their entirety.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In accordance with a first aspect of the present disclosure, a chambered platen for use in a media transport system operatively associated with a printing system is provided. The chambered platen includes a chambered honeycomb core having a plurality of hollow columnar cells formed between vertical walls, the plurality of hollow columnar cells being arranged into a plurality of rows wherein each row includes two or more adjacent hollow columnar cells. The chambered platen also includes at least one face layer as an outermost layer of the platen, which is operatively connected to the chambered honeycomb core and includes a plurality of slots in vacuum communication with the plurality of hollow columnar cells of the chambered honeycomb core. At least one surface of the chambered platen is configured to operatively connect to a vacuum source and communicate a negative pressure through the plurality of hollow columnar cells and plurality of slots. At least a first hollow columnar cell within at least a first row of the chambered honeycomb core is in vacuum communication with at least a second hollow columnar cell within the same row via an aperture. Further, at least a third hollow columnar cell within at least a second row of the chambered honeycomb core is in vacuum isolation (i.e., is not in vacuum communication) with at least a fourth hollow columnar cell within the same row.

In exemplary embodiments of the present disclosure, each hollow columnar cell within at least a first row of the chambered honeycomb core is in vacuum communication with each adjacent hollow columnar cell within the same row via a plurality of apertures/holes. Each of these hollow columnar cells may include a bottom surface substantially blocking the flow of a fluid (e.g., air/vacuum). In further embodiments, there is at least one row of hollow columnar cells in the chambered honeycomb core wherein each cell is not in vacuum communication (i.e., is isolated from) each adjacent cell within the same row. In such rows of the chambered honeycomb core, each hollow columnar cell may not have a bottom surface blocking the flow of a fluid (e.g., air/vacuum).

In accordance with another aspect of the present disclosure, a media transport system operatively associated with a printing system is provided. The media transport system includes a perforated belt, a platen, and a vacuum plenum. The perforated belt can have a plurality of belt apertures mounted onto a plurality of rollers. The platen can have a surface disposed below the perforated belt including a chambered honeycomb core, the chambered honeycomb core having a plurality of hollow columnar cells formed between vertical walls, the plurality of hollow columnar cells being arranged into a plurality of rows. Each row of the plurality of rows can include two or more adjacent hollow columnar cells. At least a first hollow columnar cell within at least a first row of the plurality of rows is in vacuum communication with at least a second hollow columnar cell within the same row via an aperture. At least a third hollow columnar cell within at least a second row of the plurality of rows is in vacuum isolation from at least a fourth hollow columnar cell within the same row (i.e., the third and fourth cells cannot communicate a vacuum pressure between them). Further, the vacuum plenum is operatively connected to a vacuum source and configured to apply a negative pressure to a media through the chambered honeycomb core and plurality of belt apertures, which is used for securing the media to the perforated belt.

In accordance with a third aspect of the present disclosure, a process for operating a platen used in a media transport system associated with a printing system is provided. The process includes the step of: applying a vacuum pressure to a media substrate through the platen, wherein the platen includes a chambered honeycomb core comprising a plurality of hollow columnar cells formed between vertical walls and arranged into a plurality of rows, wherein each row includes two or more adjacent hollow columnar cells. The vacuum pressure may be generated by a vacuum source, i.e., the vacuum pressure is applied from the vacuum source. The process also includes the step of: disabling the vacuum pressure applied to the media substrate through at least a first row of the chambered honeycomb core, wherein the first row is associated with a leading edge or trailing edge of the media substrate. That is, when the leading or trailing edge is reaches a position near the first row of the honeycomb core, that row is prevented from applying a vacuum pressure to the media substrate. Further, the process includes the step of: enabling the vacuum pressure applied to the media substrate through at least the first row of the honeycomb core when the first row is no longer associated with either the leading edge or the trailing edge of the media substrate. In other words, once the leading or trailing edge of the media substrate passes by the first row, the first row again applies a vacuum pressure to the media substrate.

In exemplary embodiments of the present disclosure, the process is repeated for each row of hollow columnar cells of the chambered honeycomb core within each marking zone of the associated printing system. That is, the rows of hollow columnar cells within the marking zone of the associated printing system are sequentially enabled/disabled as the leading and trailing edges of the media substrate advances along the media transport system.

BRIEF DESCRIPTION OF THE DRAWINGS

The following is a brief description of the drawings which are presented for the purposes of illustrating the exemplary embodiments disclosed herein and not for the purposes of limiting the same.

DETAILED DESCRIPTION

Figure 1:
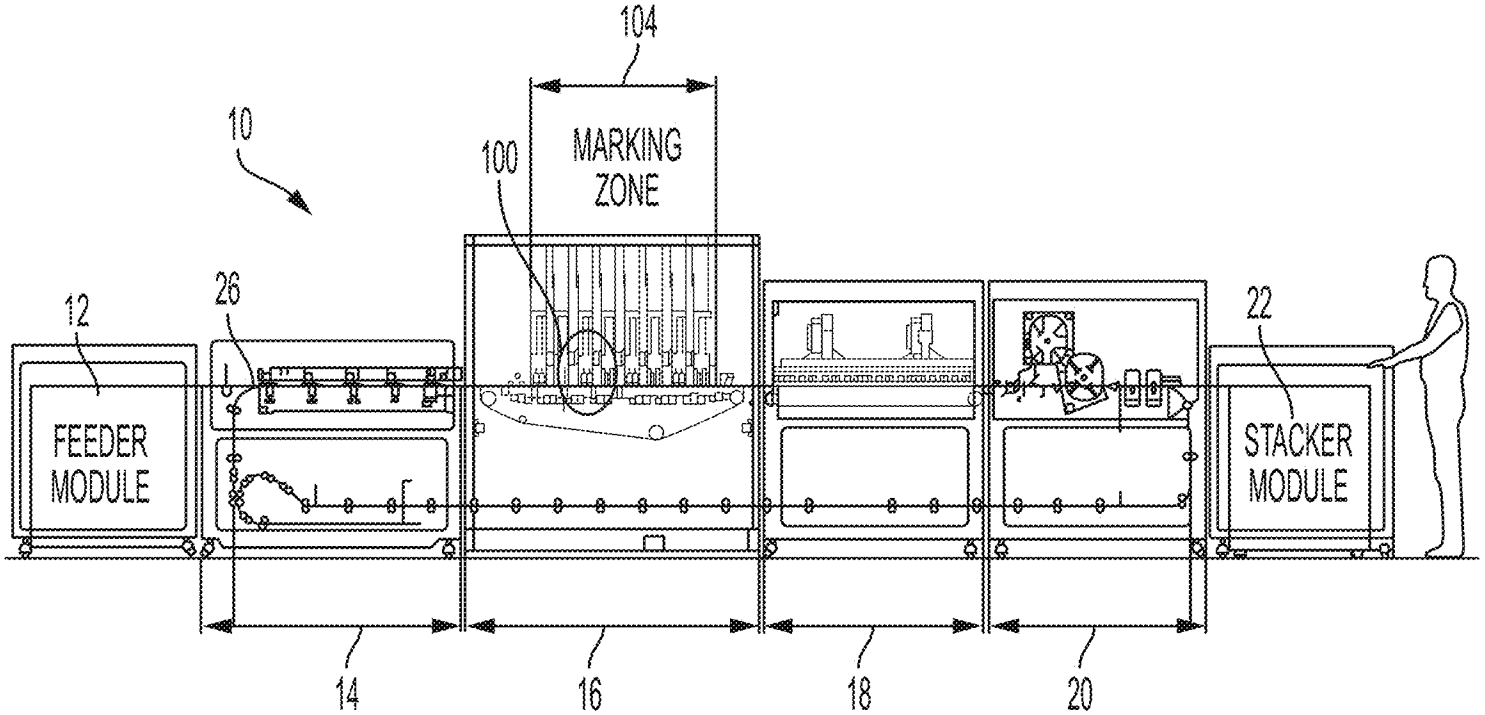
FIG. 1 illustrates a side view of an exemplary printing system incorporating a marking module and transport system.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/components/steps and permit the presence of other ingredients/components/steps. However, such description should be construed as also describing compositions, articles, or processes as "consisting of" and "consisting essentially of" the enumerated ingredients/components/steps, which allows the presence of only the named ingredients/components/steps, along with any impurities that might result therefrom, and excludes other ingredients/components/steps.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

The term "media" as used throughout this disclosure is understood by one of ordinary skill in the present technology as referring, e.g., to a pre-cut and generally flat sheet of paper, film, parchment, transparency, plastic, fabric, photo-finished substrate, paper-based flat substrate, or other substrate, whether coated or non-coated, on which information including text, images, or both can be reproduced. Generally, at least a portion of the information noted may be in digital form, since pre-imaged substrates may include images that are not digital in origin. The information can be reproduced as repeating patterns on media in the form of a web.

FIG. 1 illustrates a side view of an exemplary printing system 10 incorporating a marking module 16 and transport system 100. The schematic illustration depicts a digital printing press/system 10 for printing large media, for example, B1 and B2 sized sheets of paper. The exemplary printing press 10 includes a feeder module 12, a registration module 14, a marking module 16, a dryer module 18, an output module 20, and a stacker module 22. It is to be understood that the modules 12-22 are non-limiting and that some modules may be absent from the system 10 or the printing press system 10 may include other modules such as a module for media processing. Recording media are processed by the print press 10 along a media path 26 in a processing direction. The processing direction in FIG. 1 is from left to right and shown as the direction from the feeder module 12 to the stacker module 22. The printing press 10 starts processing at the feeder module 12. The feeder module 12 stores sheets of media and starts a printing process by supplying a sheet of media to the media path 26. The media path 26 may include a plurality of rollers or similar devices configured to advance the media sheet in the processing direction. The sheet/substrate of media is transported via the media path 26 in the processing direction from the feeder module 12 to the registration module 14 wherein the media is aligned for entry to the marking module 16. Registration may be achieved by sets of nip rolls or by other means known in the art. The nip rolls are released when a lead edge of the media substrate is acquired by the transportation system 100 of the marking module 16.

The marking module 16 utilizes a media transport system, described in greater detail below, that includes a transport belt that acquires the media substrate, places the media substrate in a printing zone, maintains the flatness of the media substrate during printing, and transports the media substrate to the next module along the processing direction. For example, after the printing process by the marking module 16 is complete, the printed media substrate is transported and dried/cured in the dryer module 18 along the processing direction. After the printed media substrate is dried/cured, the dried/cured media may be output from the printing system 10 and in some embodiments, stacked by a stacking module 22.

Figure 2:
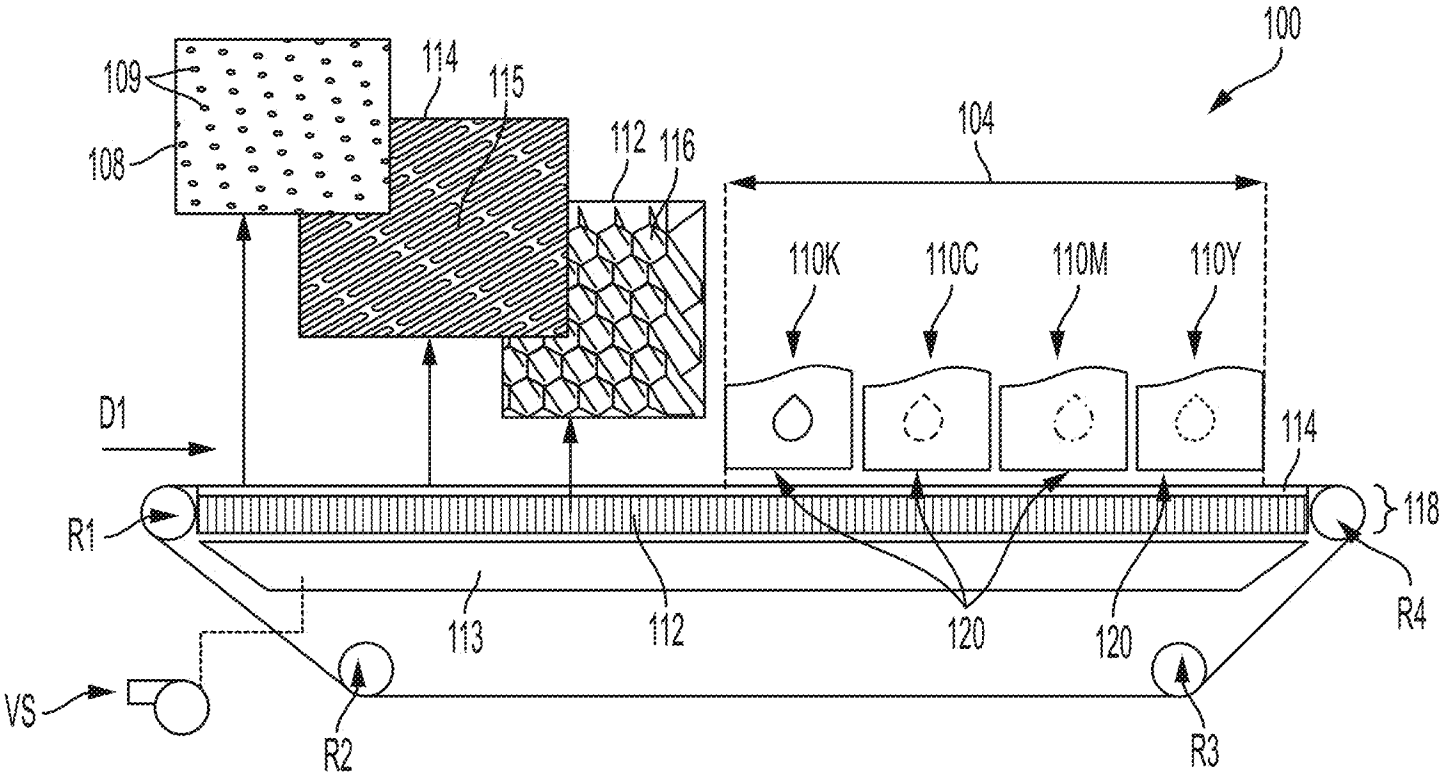
FIG. 2 illustrates a side view of an exemplary media transport system associated with a printing system.

FIG. 2 depicts a media transport system 100 of a marker module 16 having a honeycomb core 112. The media transport system 100 is used for transporting media to and through a print zone 104. This system 100 is presented to illustrate the basic operations and components of a media transport system 100 associated with a printing system, such as printing system 10. The exemplary media transport system 100 includes a smooth-surfaced belt 108, seamed or seamless, mounted on a plurality of rollers, such as rollers R1, R2, R3, and R4. At least one roller of the plurality of rollers is operably connected to a motor (not shown) to drive the belt 108. That is, the operably connected motor causes the belt to advance such that a media substrate that is present on the belt 108 is "transported", i.e., moved in a processing direction D1. While FIG. 2 illustrates a transport system 100 associated with a marking module 16 and transportation through a print zone 104, it is to be appreciated that such a transport system 100 may be used in other modules to transport the media substrate in a desired direction.

The print zone 104 illustrated in FIG. 2 is shown as an area generally under the inkjet printheads 100, represented by exemplary black ink printhead 110K, exemplary cyan ink printhead 110C, exemplary magenta ink printhead 110M, and exemplary yellow ink printhead 100Y. The number and color of the printheads 110 are non-limiting. That is, additional printheads may be included in the marking module 16 and the print zone 104 would therefore include those additional printheads. Each of the above-mentioned inkjet printheads 110K, 110C, 110M, 110Y includes its own face plate 120, which is closely spaced to the transport belt 108 for precisely jetting its ink onto a media substrate that is carried by the transport belt 108 through the print zone 104.

The transport belt 108 is illustrated in the exemplary transport system 100 as an endless loop. The endless loop shape of the transport belt 108 is dimensioned to fit snuggly on the plurality of rollers, e.g., R1, R2, R3, R4. That is, the transport belt 108 is a flat loop having an interior surface that is configured to contact an outer surface of the plurality of rollers R1, R2, R3, R4 and an exterior surface that is configured to contact and transport a media substrate. In some embodiments, each of the plurality of rollers R1, R2, R3, R4 has a rubber coating for electrically isolating each of the rollers from an inner surface of media transport belt 108. The transport system 100 may also include a tension roller (not shown) for adjusting a desired tension of the transport belt 108.

The movement of the transport belt 108 is facilitated by a motor operably connected to at least one roller of the plurality of rollers. A media substrate is captured by the transport belt 108 along the processing direction D1, for example, from a registration module 14 or feeder module 12. The transport belt 108 moves in the processing direction D1, which further enables a media substrate placed on the transport belt 108 to advance toward the print zone 104 of the marking module 14. In the print zone 104, tiny droplets of ink are sprayed onto the transported media in a controlled manner for the purpose of printing a desired image or text onto the media passing by.

In conventional direct-to-media inkjet marking engines, an inkjet printhead is mounted such that its face plate 120 (i.e., where ink nozzles are located) is spaced typically 1 mm or less from the media surface. Since media such as paper may possess a curl property that lifts at least a portion of the media more than 1 mm above the surface of the transport belt 108, the curl property of the media poses a problem whenever sheets of paper contact a printhead when passing through the print zone 104.

Thus, the exemplary transport system 100 may also include a mechanism for securing a sheet of media in place on the transport belt 108. One such mechanism is the utilization of a vacuum system, e.g., a vacuum plenum 113 with a honeycomb platen 118 as its upper surface. U.S. Pat. No. 8,408,539, incorporated by reference in its entirety herein, discloses a media sheet transport utilizing a vacuum plenum in combination with a transport belt. Similarly, U.S. patent application Ser. No. 16/506,134, incorporated by reference in its entirety herein, discloses a multilayered honeycomb core platen for media transport. Generally, the vacuum plenum 113, as illustrated in FIG. 2, is a chamber or place in which a negative pressure is applied. As used herein, "negative pressure" refers to an air pressure that is below atmospheric pressure. A vacuum source VS is operably connected to the vacuum plenum 113 so that the vacuum plenum 113 applies a negative pressure through the honeycomb platen 118 to the media for holding the media flat to the transport belt 108.

The platen 118 presents a flat top surface against which the transport belt 108 and carried media is held. The transport belt 108 is caused to slide across the flat top surface of the platen 118 by a motor (not shown) powering at least one of the rollers R1, R2, R3, R4, to cause sheets of media (not shown) carried by the transport belt 108 to move. In operation, the platen 118 presents a fixed surface and the transport belt 108 is caused to slide thereacross. A platen 118 may be included on the top of the vacuum plenum 113 over which the transport belt 108 translates. The honeycomb platen 118 may be variously embodied as multilayered platens (see U.S. patent application Ser. No. 16/506,134). Generally, the platen 118 may have at least one face layer 114 including a plurality of slots 115 configured to communicate the vacuum (i.e., negative pressure generated by the vacuum source VS) from the plenum 113 to the top-most surface. The transport belt 108 may include a plurality of apertures 109 formed therein such that the vacuum may flow down through the transport belt 108 and platen 118. In other words, the slots 115 and belt apertures 109 enable the vacuum plenum 113 and platen 118 to subject the media carried by the transport belt 108 to a vacuum pressure. Accordingly, a sheet of media transport over the platen 118 will be held down onto the transport belt 108 by a vacuum force.

As briefly described above, the transport belt 108 may be perforated, including a plurality of apertures 109 distributed substantially across its width for enabling the vacuum plenum 113, located beneath the transport belt 108, to cause media to be drawn to the transport belt 108. In some embodiments, a square pattern for the apertures 109 is used, wherein an individual aperture 109 is generally circular. In some embodiments, the circular apertures have a diameter of about 2 mm. The size, pattern, and grouping of the apertures 109 are non-limiting and may be varied to achieve a particular vacuum state as different media substrates may require specific vacuum conditions/air flow.

The platen 118 may be a lightweight, high strength-to-weight ratio, honeycomb platen 118. The honeycomb structure (i.e., comprising cells 116) provides a core having a low density yet relatively high compression and sheer properties. That is, over 50% of the volume of the honeycomb core 112 is occupied by air. In some embodiments, about 50% to about 97% of the volume of the honeycomb core 112 is occupied by air. With reference to the exemplary embodiment honeycomb platen 200 of FIG. 3, the geometry of the honeycomb structure features an array of hollow cells 203 formed between vertical walls 204. The vertical walls 204 may be formed of a foil substrate that is processed to create an array of hollow cells 203. The vertical walls 204 are generally thin, having a thickness from about 0.025 mm to about 4.0 mm. The cells 203 are generally columnar and generally hexagonal in shape, although other similar shapes may also be used, including tubular, triangular, and square shapes. The honeycomb core 202 is characterized by having a high strength-to-weight ratio and is configured to provide a stable and robust base. In some embodiments, the honeycomb core 202 is composed of a metal material. In more particular embodiments, the metal material of the honeycomb core 202 is aluminum. In other embodiments, the honeycomb core 202 is made of a non-metal material, for example and without limitation, fiberglass and/or composite materials. The honeycomb structure of the core 202 allows for a 37× increase in stiffness at approximately the same weight as a homogenous material, such as a solid metal platen. The honeycomb core 202 also allows for the platen to have a large area with the required flatness of a large media print system. In some embodiments, the flatness is less than about 300 μm. In further embodiments, the flatness is less than about 200 μm. In still further embodiments, the flatness is less than 150 μm.

Figure 3:
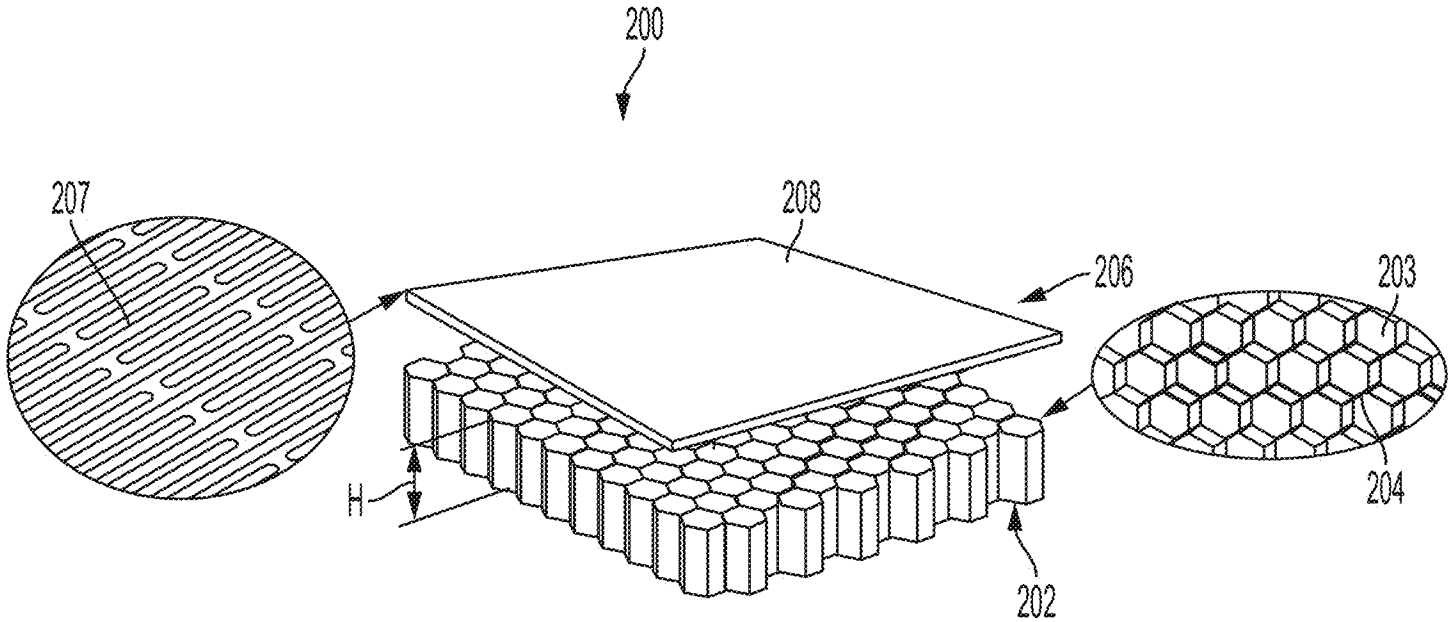
FIG. 3 illustrates an exploded view of a honeycomb platen in accordance within an exemplary embodiment of the present disclosure.

With further reference to FIG. 3, the honeycomb core 202 may range in height (corresponding to a height H of the columnar cells 203) from about ⅛ inch (3.175 mm) to about 1.5 inches (38.1 mm), including about ¼ inch (6.35 mm), about ⅜ inch (9.525 mm), about ½ inch (12.7 mm), about ⅝ inch (15.875 mm), about ¾ inch (19.05 mm), about 1 inch (25.4 mm), about 1⅛ inches (28.575 mm), about 1¼ inches (31.75 mm), and about 1⅜ inches (34.925 mm).

The hollow honeycomb cells 203 of the honeycomb core 202 allow for the passage of air and/or vacuum that may be communicated by an adjacent vacuum platen, such as vacuum plenum 113 described above. In other words, the honeycomb core 202 is operatively connected to a vacuum source VS via a vacuum plenum 113. In some embodiments, a surface of the honeycomb core 202 is in direct contact with the vacuum plenum 113. In other embodiments, a surface of a layer laminated to the honeycomb core 202 (an outermost surface of the platen) is in direct contact with a vacuum plenum 113 such that negative pressure of the vacuum plenum is communicated through the hollow cells 203 of the honeycomb core 202.

The platen may be variously embodied in accordance with this disclosure, for example, as a multi-layer platen design that is bonded together via a lamination process (see U.S. patent application Ser. No. 16/506,134). In the exemplary embodiment illustrated in FIG. 3, the honeycomb platen 200 includes a face layer 206. The face layer 206 has a top surface 208 that is configured to contact an associated transport belt, such as transport belt 108 described above and associated with a transport system 100. The top surface 208 of the face layer 206 is a surface with a low coefficient of friction such that the transport belt may easily slide over the face layer 206 with minimal to no degradation of the transport belt or platen surface 208.

The face layer 206 includes a plurality of slots 207 through the layer that are configured to communicate air and/or vacuum from the cells 203 of the honeycomb core 202. That is, the slots 207 may align with the hollow cells 203 of the core 202 allowing a vacuum platen, such as vacuum plenum 113 placed in vacuum communication with the honeycomb core 202, to draw a vacuum through the plurality of the slots 207. In some embodiments, the slots 207 are further configured to communicate a vacuum force through apertures in an associated perforated belt, such as apertures 109 of belt 108 described above. The face layer 206 is generally composed of a thin sheet of material having a thickness from about 1/16 inch (1.5875 mm) to about 1/4 inch (6.35 mm). The pattern, shape, and size of the slots 207 may be optimized to have a vacuum flow for transporting and maintaining the flatness of a particular type of media substrate, for example and without limitation, paper and carboard media.

In some embodiments, a coating may be applied to the top surface 208 of the face layer 206. The coating may facilitate sliding movement between the face layer 206 and an associated belt (such as transport belt 108). The coating may be a low friction coating such as a Teflon® coating. In some embodiments, the coating provides a surface with a coefficient of friction of about 0.3. In preferred embodiments, the coating provides a surface with a coefficient of friction less than about 0.3.

Generally, at least one slot 207 of the face layer 206 is configured to communicate air/vacuum with at least one hole 109, resulting in air/vacuum communication with at least one columnar cell 203. In some embodiments, a slot 207 extends along a length of the face layer 206 such that it spans the distance of two or more holes 109. The air/vacuum pressure applied by the vacuum source VS via the vacuum plenum 113 draws air through the apertures 109 of the perforated belt 108, the slots 207 of the face layer 206, and through the cells 203 of the honeycomb core 202, generally in a direction perpendicular (vertically) to the processing direction D1.

Figure 4:
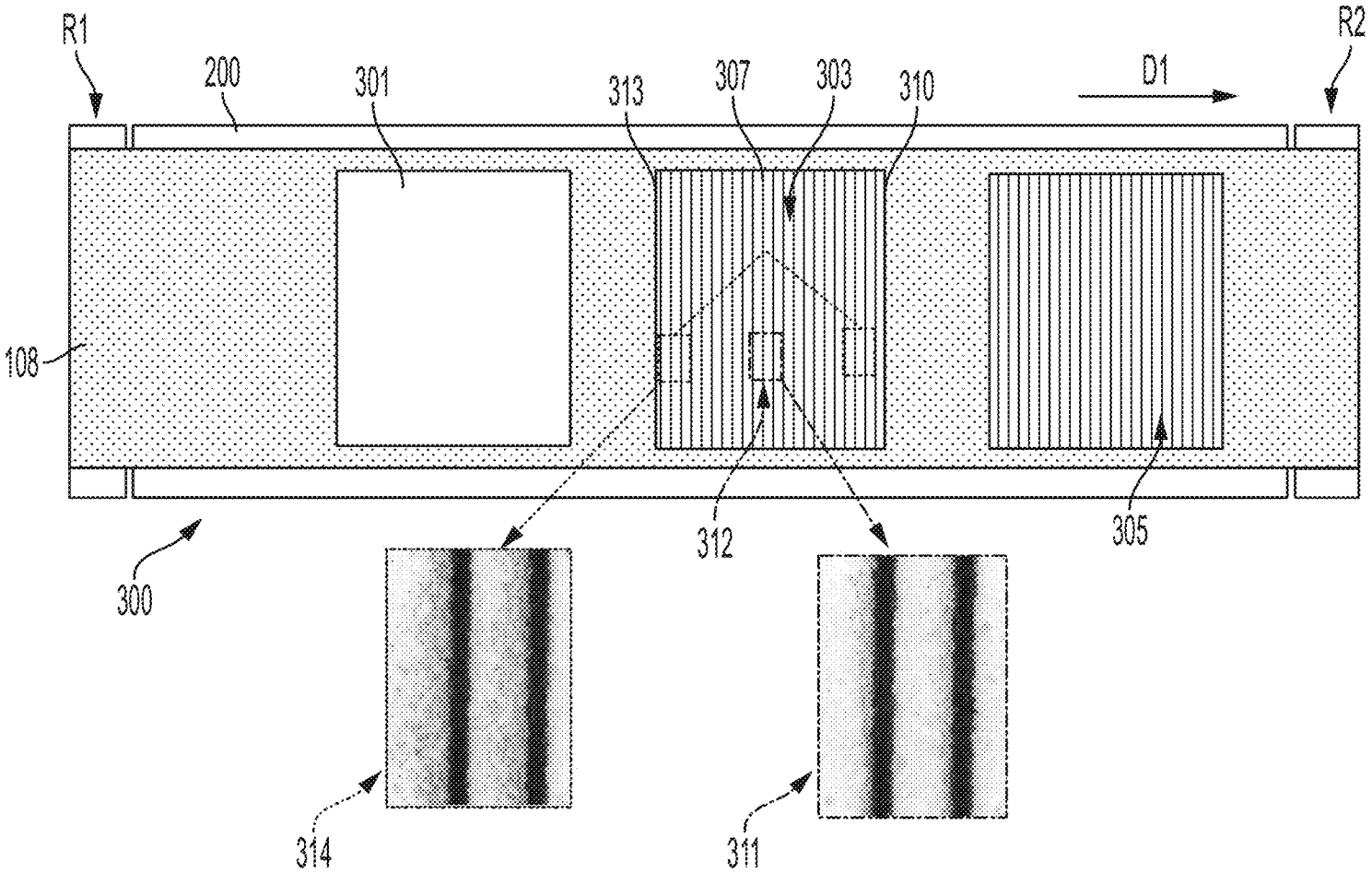
FIG. 4 illustrates a top view of a media transport system associated with a printing system and certain print quality defects.

However, turbulence in the air flow/vacuum is an issue as the leading and trailing edges of a media substrate travels under the marking zones 104 and airflow alternates from being restricted (i.e., media substrate blocking the air flow path) and unrestricted (i.e., media substrate has moved along the processing direction D1 no longer blocking the air flow path) in the inter-print gap. As a result of the air disturbance, ink droplet trajectory is affected causing print quality defects, such as image blurring. For example, FIG. 4 illustrates the effect of such turbulence on print quality at the leading and trailing edges 310, 313 of a substrate 303. As shown, various media substrates 301, 303, 305 pass through a marking zone (not shown) of a transport system 300 and an image is produced on the substrate 303, such as a pattern of lines 307, as the perforated belt 108 moves the substrates 301, 303, 305 in the processing direction D1. An enlarged view 314 of the leading and trailing edges 310, 313 is illustrated along with an enlarged view 311 of an interior region 312 of the substrate 303. Due to the air turbulence caused by the vacuum plenum (not shown), there is significant blurring in outer region 314 associated with the leading and trailing edges 310, 313 of the substrate 303, which is not as severe in the inner region 311, 312 of the substrate 303. This is at least in part due to the turbulence in the air flow/vacuum at the leading and trailing edges 310, 313.

Figure 5:
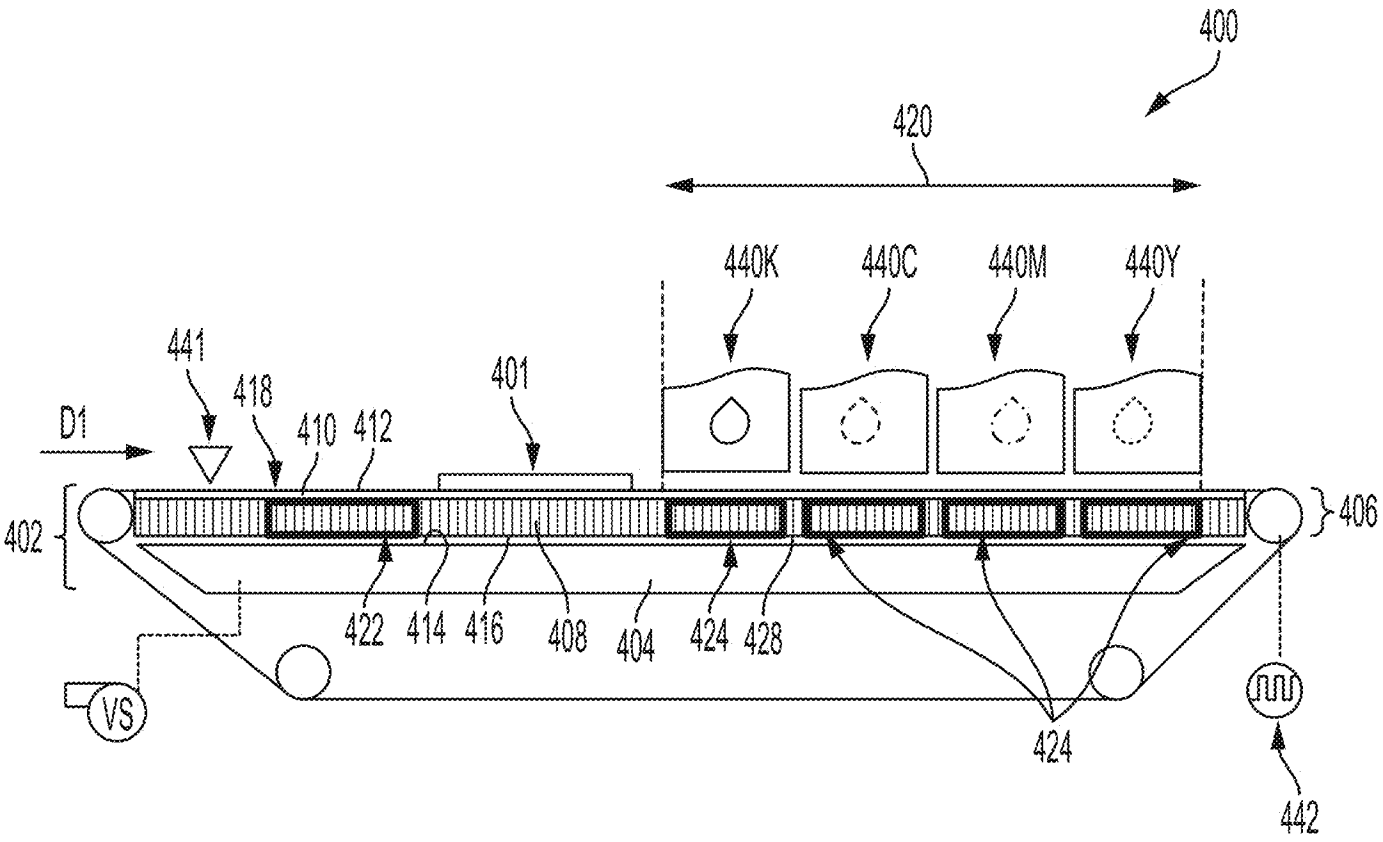
FIG. 5 illustrates a side view of a media transport system having a chambered vacuum transport platen enabled by a honeycomb core in accordance with an exemplary embodiment of the present disclosure.

Turning to FIG. 5, to address the aforementioned issues and particularly the turbulence issue, a transport system 400 with a chambered plenum 402 having a chambered honeycomb platen 406 is provided in accordance with the present disclosure. As previously described, the transport system 400 includes a perforated belt 412, seamed or seamless, mounted on a plurality of rollers, such as rollers R1, R2, R3, and R4. At least one roller of the plurality of rollers is operably connected to a motor (not shown) to drive the belt 412, thereby causing a sheet of media 401 that is on the belt 412 to be "transported", i.e., moved in a processing direction D1. The perforated belt 412 is generally formed as an endless loop and is configured to fit snuggly on the plurality of rollers, e.g., R1, R2, R3, and R4. In some embodiments, each of the rollers R1, R2, R3, and R4 has a rubber coating to electrically isolate each of the rollers from an inner surface of the media transport belt 412. The transport system 400 may also include additional rollers, such as a tension roller (not shown) for adjusting a desired tension of the perforated belt 412.

The transport system 400 includes a vacuum plenum 404 with a honeycomb core platen 406 as its upper surface. The vacuum plenum 404 is a chamber in which a negative pressure is applied via a connection to a vacuum source VS (e.g., a vacuum pump). The main vacuum plenum 404 has a plenum surface 414 that is operably connected to an opposing surface 416 of the honeycomb core platen 406. The vacuum plenum 404 is configured to apply a negative pressure through the honeycomb core platen 406 and to the media 401 for holding the media 401 to the belt 412.

The chambered honeycomb core platen 406 presents a flat surface 418 against which the perforated transport belt 412 is held. The honeycomb platen 406 may be variously embodiment, e.g., a multi-layered platen as described in U.S. patent application Ser. No. 16/506,134. In the exemplary embodiment illustrated in FIG. 5, the chambered honeycomb platen 406 may have at least one face layer 410 including a plurality of slots (e.g., slots 207 shown in FIG. 3). Perforated transport belt 412 is caused to slide across the flat surface of the platen 406 by a motor (not shown) powering at least one of the rollers R1, R2, R3, and R4, to cause sheets of media 401 carried by the media transport belt 412 to move in the processing direction D1. In some embodiments, the media transport system 400 is incorporated into a marking module of a printing system and the transport system is configured to transport a media substrate through a print zone.

The chambered honeycomb platen 406 of the exemplary transport system 400 is in air/vacuum communication with the vacuum plenum 404. The chambered honeycomb platen 406 includes a chambered honeycomb core 408 similarly configured to the honeycomb core 408 of FIG. 2 and FIG. 3 as described above. With reference to FIG. 3 and FIG. 5, the chambered honeycomb core 408 includes a plurality of hollow cells 203 formed between thin vertical walls 204. The cells 203 are generally columnar and generally hexagonal in shape, although the shape of the cells 203 is non-limiting. The hollow cells 203 are configured to communicate a vacuum drawn from the vacuum plenum 404 through a plurality of apertures extending substantially across an associated belt 412 (e.g., apertures 109 shown in FIG. 2). This enables the vacuum plenum 404 located beneath the belt 412 to cause media 401 to be drawn to the belt 412, thereby holding and securing the media substrate 401 thereon.

The hollow honeycomb cells 203 of the honeycomb core 408 allow for the passage of air (i.e., vacuum) that may be communicated by an adjacent vacuum plenum 404. In other words, the honeycomb core 408 is operatively connected to a vacuum source VS. The chambered honeycomb platen 406 is operably connected to the vacuum plenum 404 such that negative pressure of the vacuum plenum 404 is communicated through the hollow cells 203 of the honeycomb core 408.

Generally, outside of the marking zone 420, the chambered honeycomb platen 406 is operably connected to the vacuum plenum 404 such that negative pressure of the vacuum plenum 404 is pulled vertically down through hollow cells 203 of the honeycomb core 408. For example, with reference to FIG. 5 and FIG. 6A, a portion 422 of the chambered honeycomb core 408 is illustrated in a side view, wherein air flow (i.e., vacuum pressure) is pulled down through the hollow cells 203. In other words, the vacuum pressure generated by the vacuum VS and communicated through the vacuum plenum 404 is translated through the honeycomb core 408 straight through the hollow cells 203 of the honeycomb core 408. That is, the air flow F1 is vertically perpendicular to the processing direction D1 of the media substrate 401.

Figure 6B:
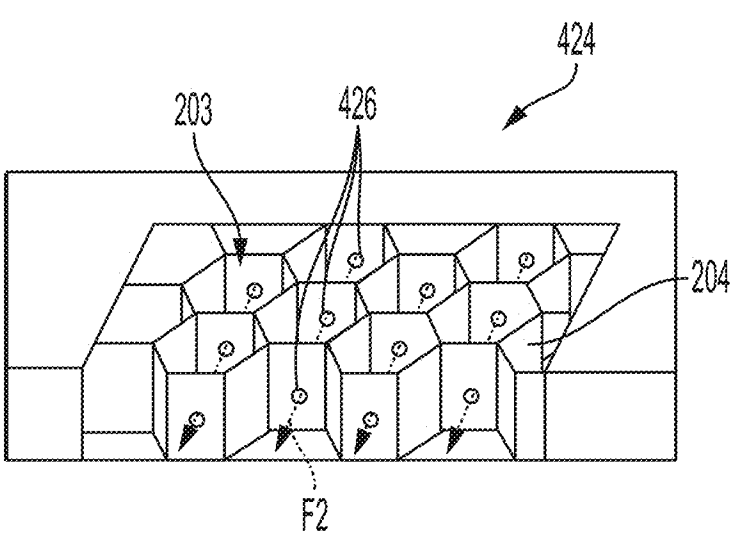
FIG. 6B illustrates a cross-drilled/chambered portion of the chambered honeycomb core used in an associated chambered platen in accordance with an exemplary embodiment of the present disclosure.
Figure 6A:
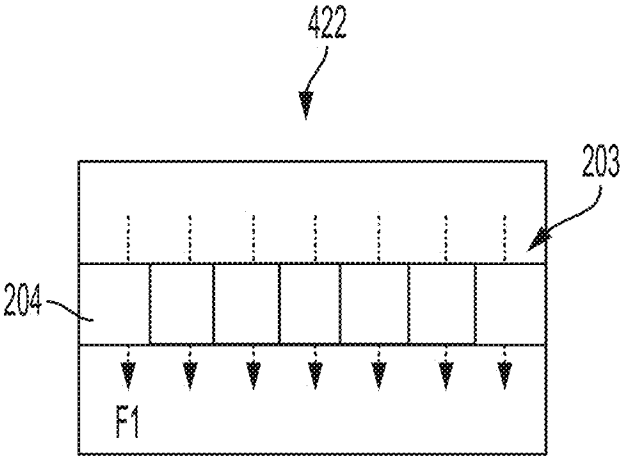
FIG. 6A illustrates a portion of a first region of the chambered honeycomb core used in an associated chambered platen in accordance with an exemplary embodiment of the present disclosure.

However, as illustrated in the exemplary embodiment of FIG. 5, the chambered honeycomb platen 406 may also comprise a plurality of chambered sections 424 within each marking zone 420. With reference to FIG. 5 and FIG. 6B, within each chambered section 424 of the chambered honeycomb platen 406, the hollow cells 203 of the honeycomb core 408 may be cross drilled with holes/apertures 426. In such chambered sections 424, the honeycomb platen 406 is operably connected to the vacuum plenum 404 such that negative pressure of the vacuum plenum 404 is pulled horizontally from adjacent cells 203. That is, the underside of the honeycomb cells 203 within the chambered sections 424 are blocked so to not allow vacuum to be drawn vertically through them. Instead, the air flow/vacuum pressure F2 exerted by the vacuum source VS via the vacuum plenum 404 is pulled vertically down through the perforated belt 412 into the cells 203 of the chambered honeycomb core 408 and then horizontally through the honeycomb core 408 itself. In this context, the term "horizontally" does not necessarily mean parallel to the processing direction D1. Rather, the air flow/vacuum within the chambered section 424 of the honeycomb core 408 is horizontal and perpendicular to the processing direction D1. As illustrated in FIG. 5 and FIG. 6B, the negative air pressure (generated via the operably connected vacuum plenum 404) creates a hold-down force on the substrate 401 through the perforated belt 412, drawing the vacuum down into the chambered honeycomb sections 424 and then through the cross-drilled holes/apertures 426, rather than through the bottom of the cells 203, which are blocked in the chambered sections 424.

The exemplary transport system 400 may include a chambered honeycomb platen 406 having a plurality of chambered sections 424. In particular embodiments, each of the chambered sections 424 correspond to a region beneath (i.e., adjacent to) a printhead within the marking zone 420, such as printheads 440K, 440C, 440M, and 440Y. As illustrated in FIG. 5, there may be a gap or "non-chambered" section 428 between each of the chambered sections 424 within the marking zone 420, in which the chambered honeycomb platen 406 is operably connected to the vacuum plenum 404 such that air flow/negative air pressure is drawn substantially vertically through the hollow cells 203 of the honeycomb core 408, similar to the non-chambered region 422. However, in other embodiments, the entire region beneath (i.e., adjacent to) the marking zone 420 may be comprise a single chambered section 424 such that there are no gaps or "non-chambered" sections 428 within the marking zone 420.

Figure 7:
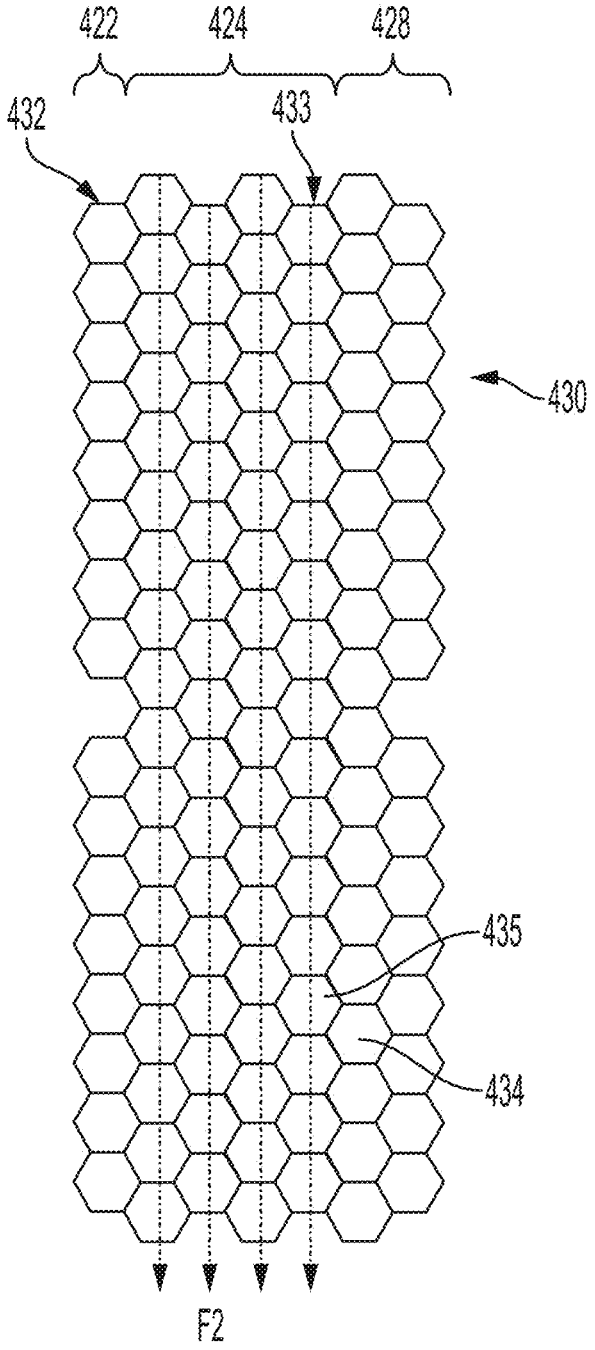
FIG. 7 illustrates a top view of a portion of the chambered honeycomb core in accordance with an exemplary embodiment of the present disclosure.

With reference to FIG. 7, a top view of a portion 430 of the chambered honeycomb core 408 is illustrated. As shown in FIG. 7, the portion 430 of the chambered honeycomb core 408 comprises a chambered section 424 with non-chambered regions (e.g., regions 422 or gaps 428) on either side. As described above, the chambered honeycomb core 408 can comprise a plurality of hollow cells 203 formed by vertical walls 204. These hollow cells 203 may be arranged into a plurality of rows 432, 433 of hollow cells 203, 434, 435. In other words, the chambered sections 424 can comprise a plurality of rows 433 of adjacent cells 435, wherein the cells 203 are cross-drilled cells 435 thereby allowing air flow/negative air pressure generated by the vacuum source VS to be pulled through each row 433 in a direction F2. As illustrated in FIG. 7, the chambered section 424 of the chambered honeycomb core 408 includes four rows 433 of cross-drilled cells 435. In contrast, the non-chambered regions 422, 428 can comprise rows 432 of non-cross drilled cells 434 wherein the air flow/negative air pressure generated by the vacuum source VS is pulled directly through each cell 434 (i.e. a single cell 434) rather than through adjacent cells.

Figure 8:
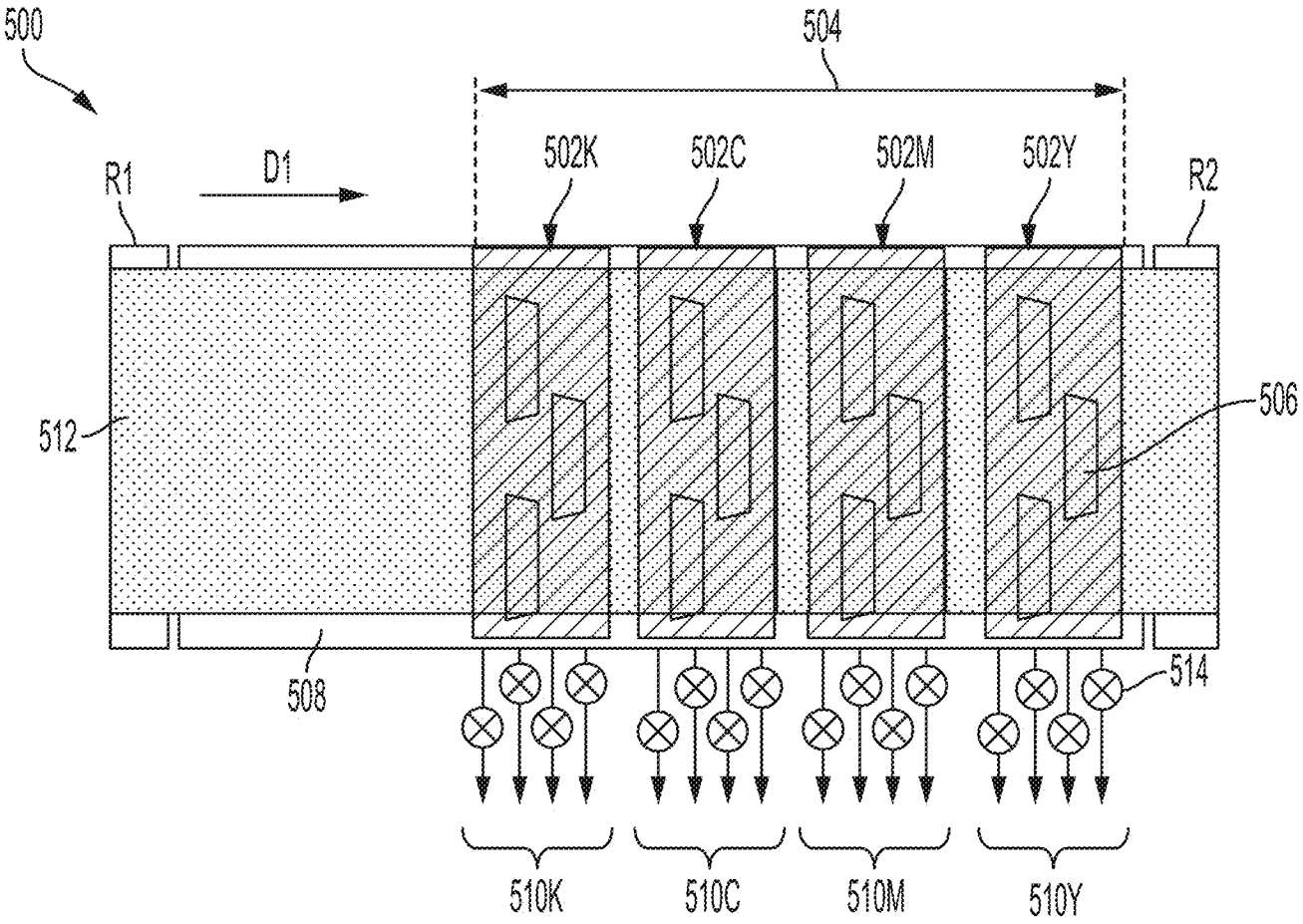
FIG. 8 illustrates a top view of a media transport system having a chambered vacuum transport platen enabled by a honeycomb core in accordance with another exemplary embodiment of the present disclosure.

With reference to FIG. 8, an exemplary transport system 500 comprising multiple marking stations 502K, 502C, 502M, and 502Y within a marking zone 504. As described above, in large-format printer systems, each marking station 502K, 502C, 502M, and 502Y may include one or more printheads 506 for ejecting ink droplets onto a media substrate (not shown) that is transported along the transport belt 512 (e.g., a perforated transport belt 108 shown in FIG. 2). The transport system 500 may include a chambered plenum including a vacuum plenum (not shown) operably connected to a chambered honeycomb platen 508 (e.g., chambered plenum 402, vacuum plenum 404, and chambered honeycomb platen 406 shown in FIG. 5). As illustrated in FIG. 8, the marking zone 504 includes a plurality of chambered sections 510K, 510C, 510M, and 510Y corresponding to each of the marking stations 502K, 502C, 502M, and 502Y. In operation, the transport system 500 may function as described above with respect to FIGS. 5-7.

In particular embodiments, valves 514 may be used to control the vacuum airflow in individual chambered sections 510K, 510C, 510M, and 510Y of the chambered honeycomb core (e.g., chambered honeycomb core 408). In further embodiments, the valves 514 may be used to independently control the vacuum airflow in individual rows (e.g., rows 433 as shown in FIG. 7) of the chambered sections 510K, 510C, 510M, and 510Y. In other words, individual sections 510K, 510C, 510M, and 510Y and/or rows (e.g., rows 433) of the chambered honeycomb core (e.g., honeycomb core 408) may be independently controlled to turn on or off the negative air pressure generated by the vacuum source VS and communicated through the those sections/rows of the honeycomb platen to the media substrate.

This enable/disable functionality is controlled depending on the position of the media substrate to reduce the air turbulence generated at the leading and trailing edges of the substrate. With reference to FIG. 5, the transport systems 400, 500 described herein may further include a sheet sensor 441 configured to detect the presence of a media substrate 401 as it moves along in the processing direction D1. The transport systems 400, 500 may also include a position encoder 442 that, together with the sheet sensor 441, tracks the progress of the media substrate 401 along the perforated belt 408. The sheet sensor 441 and position encoder 442 may be configured to facilitate the synchronization of the firing of the printheads (e.g., printheads 506), and may also be configured to coordinate the operation of the chambered sections 424 of the chambered honeycomb core 408. In other words, the sheet sensor 441 and position encoder 442 allow the transport system 400, 500 to determine where the leading and trailing edges (e.g., edges 310, 313 shown in FIG. 3) of a media substrate 401 are and to determine when to turn on or off the air flow/vacuum to particular rows 433 of the chambered sections 424 of the chambered honeycomb core 408.

In accordance with one aspect of the present disclosure, the sequential operation of a chambered transport system is provided. With reference to FIGS. 9A-9E, an exemplary embodiment of the operation of a chambered region 624 of a chambered transport system 600 is illustrated. As shown in FIG. 9A, a media substrate 601 is moving along the transport system 600 on a transport belt (not shown) underneath printheads 605 in the processing direction D1. The leading edge 603 of the media substrate 601 has yet to reach the marking zone 605. Thus, at this time, all rows 607 of the chambered honeycomb core 608 are operated normally, i.e., negative pressure generated by the vacuum source (not shown) is translated through the chambered honeycomb platen (e.g., platen 406 shown in FIG. 5).

Figure 9B:
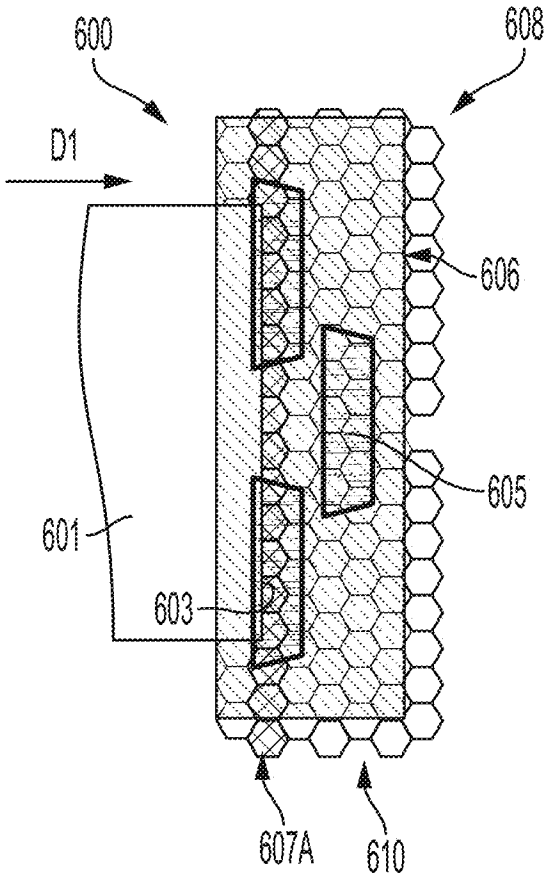
FIGS. 9A-9E illustrate the operation of an exemplary media transport system having a chambered vacuum transport platen enabled by a honeycomb core as a media substrate moves under a printhead array in accordance with an exemplary embodiment of the present disclosure.
Figure 9A:
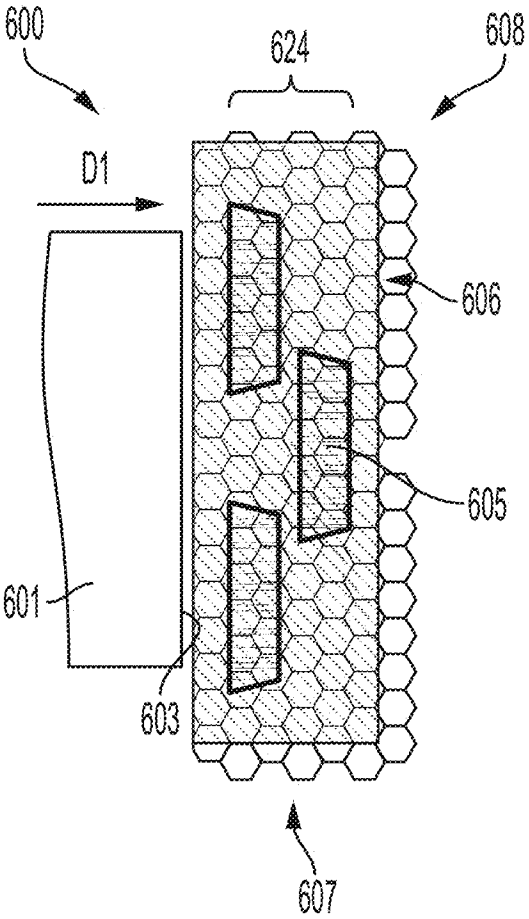

Turning to FIG. 9B, the transport system 600 has moved the media substrate 601 such that the leading edge 603 is now within the marking zone 606. As seen in FIG. 9B, a first row 607A of the chambered honeycomb core 608 is disabled while the remaining rows 610 are operated normally. That is, the first row 607A of the chambered honeycomb core 608 may be a cross-drilled row (e.g., row 433 shown in FIG. 7) and the air flow/negative pressure generated by the vacuum source is not applied to the leading edge 603 of the substrate 601 through the first row 607A. As described above, the vacuum pressure holding the substrate 601 to the transport belt (not shown) may be disabled using various means, such as a valve (e.g., valve 514 shown in FIG. 8). The leading edge 603 of the media substrate 601 may be tracked using a sheet sensor and position encoder (e.g., sheet sensor 441 and position encoder 442 shown in FIG. 5).

Figure 9D:
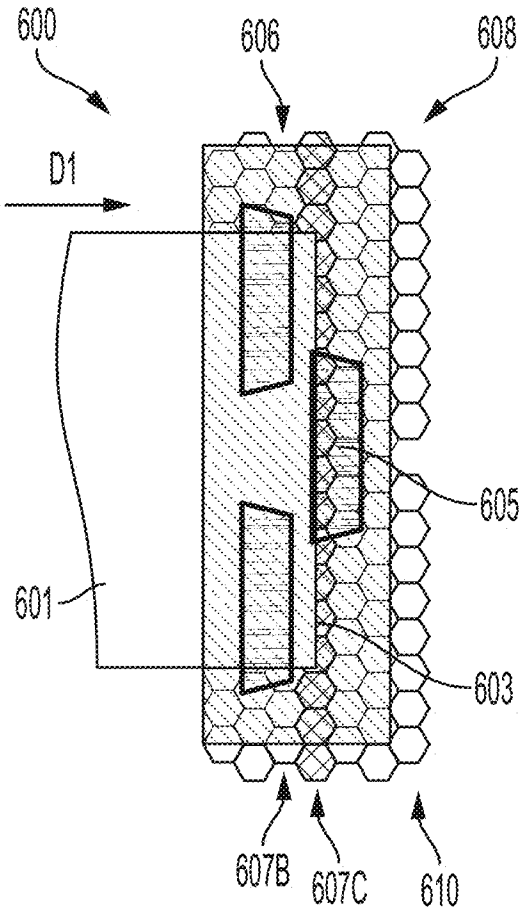
Figure 9C:
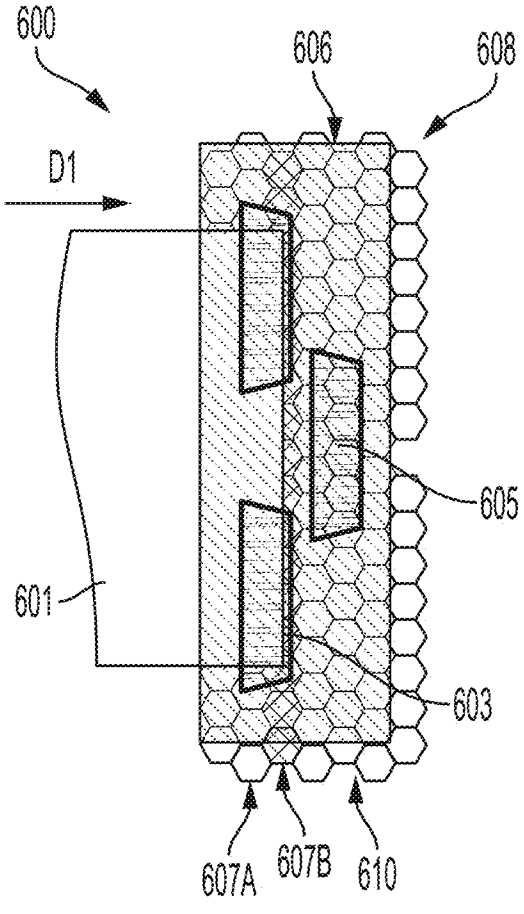

Turning to FIG. 9C, the transport system 600 has further moved the media substrate 601 such that the leading edge 603 of the substrate 601 has passed the first row 607A of the chambered honeycomb core 608. As shown, the first row 607A of the chambered honeycomb core 608 is returned to normal operation (i.e., communicating a vacuum force to the substrate 601) now that the leading edge 603 has moved along the transport system 600. However, as seen in FIG. 9C, a second row 607B of the chambered honeycomb core 608 is disabled while the remaining rows 610 are operated normally. Like row 607A, row 607B of the chambered honeycomb core 608 may be a cross-drilled row (e.g., row 433 shown in FIG. 7), thus, the air flow/negative pressure generated by the vacuum source is not applied to the leading edge 603 of the substrate 601 through the second row 607B.

Figure 9E:
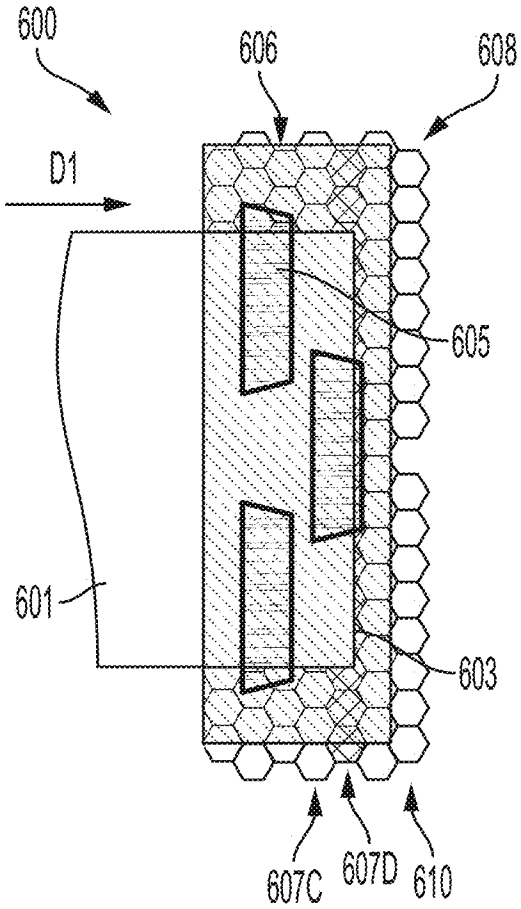

Turning to FIG. 9D, the transport system 600 has further moved the media substrate 601 such that the leading edge 603 of the substrate 601 has passed the second row 607B of the chambered honeycomb core 608 and encountered another cross-drilled row 607C. Similarly, as seen in FIG. 9E, the leading edge 603 of the media substrate 601 has passed a third 607C of the chambered honeycomb core 608 and encountered a fourth cross-drilled row 607D. As described with respect to FIG. 9B and FIG. 9C, the third and fourth rows 607C, 607D are disabled (i.e., the vacuum pressure applied via these cells is turned off) as the leading edge 603 of the media substrate 601 passes above. Once the leading edge 603 of the substrate 601 passes the rows 607C, 607D of the chambered honeycomb core 608, the vacuum pressure applied to the substrate 601 via rows 607C, 607D are re-enabled (i.e., turned back on), for example, via a valve (e.g., valve 514 shown in FIG. 8).

Thus, as described above, each cross-drilled row 607A, 607B, 607C, 607D of the chambered honeycomb core 608 is sequentially operated to stop the air flow/vacuum from being applied to the media substrate 601 as the leading edge 603 moves underneath a marking zone 606. As also described above, a transport system, such as transport system 600, may include multiple marking zones like marking zone 606. Thus, the process described with respect to FIGS. 9A-9E may be repeated for each marking zone (e.g., marking zone 606) present in the transport system (e.g., transport system 600). Further, although the process is illustrated such that only one row 607A, 607B, 607C, 607D is disabled at a time, more than one cross-drilled row may be disabled at a time to further prevent air turbulence.

Additionally, although illustrated in FIGS. 9A-9E with respect to the leading edge 603 of the media substrate 601, the same process may be applied for the trailing edge (not shown) of the substrate 601. That is, the rows 607A, 607B, 607C, 607D may be sequentially operated to turn off the air flow/vacuum pressure as the trailing edge moves underneath the marking zone(s) 605. This function may also be facilitated by the sheet sensor and position encoder (e.g., sheet sensor 441 and position encoder 442 shown in FIG. 5).

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art, which are also intended to be encompassed by the following claims.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

What is claimed is:

1. A chambered platen for use in a media transport system operatively associated with a printing system, the chambered platen comprising:

a chambered honeycomb core having a plurality of hollow columnar cells formed between vertical walls, the plurality of hollow columnar cells being arranged into a plurality of rows, each row of the plurality of rows including two or more adjacent hollow columnar cells; and at least one face layer as an outermost layer of the platen, the at least one face layer operatively connected to the honeycomb core and including a plurality of slots in vacuum communication with the plurality of hollow columnar cells;

wherein at least one surface of the chambered platen is configured to operatively connect to a vacuum source and communicate a negative pressure through the plurality of hollow columnar cells and plurality of slots;

wherein at least a first hollow columnar cell within at least a first row of the plurality of rows is in vacuum communication with at least a second hollow columnar cell within the first row via an aperture; and wherein at least a third hollow columnar cell within at least a second row of the plurality of rows is in vacuum isolation from at least a fourth hollow columnar cell within the second row.

2. The chambered platen according to claim 1, wherein each hollow columnar cell within the first row of the plurality of rows is in vacuum communication with each adjacent hollow columnar cell within the first row via an aperture.

3. The chambered platen according to claim 1, wherein each hollow columnar cell within two or more adjacent rows of the plurality of rows is in vacuum communication with each adjacent hollow columnar cell within each row of the two or more adjacent rows via an aperture.

4. The chambered platen according to claim 3, wherein each of the hollow columnar cells within the two or more adjacent rows comprises a bottom surface configured to block the communication of a vacuum vertically through individual hollow columnar cells.

5. The chambered platen according to claim 3, wherein each of the hollow columnar cells within the two or more adjacent rows are configured to communicate a vacuum through each adjacent hollow columnar cell within each row via a plurality of apertures connecting each adjacent hollow columnar cell within each row.

6. The platen according to claim 1, further comprising a low friction coating disposed on an outer surface of the at least one face layer, wherein the low friction coating minimizes the friction between the face layer and an associated belt.

7. The platen according to claim 1, wherein the chambered honeycomb core may have a height from about 3.175 mm to about 38.1 mm.

8. The platen according to claim 1, wherein the vertical walls forming the plurality of hollow columnar cells have a thickness from about 0.025 mm to about 4.0 mm.

9. The platen according to claim 1, wherein the chambered honeycomb core has a flatness of less than about 300 μm.

10. The platen according to claim 1, wherein from about 50% to about 97% by volume of the chambered honeycomb core is occupied by air.

11. A media transport system operatively associated with a printing system comprising:

a perforated belt including a plurality of belt apertures mounted on a plurality of rollers;

a platen having a surface disposed below the perforated belt including a chambered honeycomb core having a plurality of hollow columnar cells formed between vertical walls, the plurality of hollow columnar cells being arranged into a plurality of rows, each row of the plurality of rows including two or more adjacent hollow columnar cells; and a vacuum plenum being operatively connected to a vacuum source and configured to apply a negative pressure to a media through the chambered honeycomb core and plurality of belt apertures for securing the media to the perforated belt;

wherein at least a first hollow columnar cell within at least a first row of the plurality of rows of the chambered honeycomb core is in vacuum communication with at least a second hollow columnar cell within the first row via an aperture; and wherein at least a third hollow columnar cell within at least a second row of the plurality of rows of the chambered honeycomb core is in vacuum isolation from at least a fourth hollow columnar cell within the second row.

12. The media transport system of claim 11, wherein the platen further comprises at least one face layer as an outermost layer of the platen and is configured to contact an inner facing surface of the belt, the face layer including a plurality of slots in vacuum communication with the chambered honeycomb core and belt apertures.

13. The media transport system of claim 12, wherein the at least one face layer includes a first face layer having a plurality of first slots having a first slot size and first slot shape, wherein vacuum is communicated from the vacuum plenum to the belt through the plurality of first slots of the first face layer and the columnar cells of the honeycomb core.

14. The media transport system of claim 11, wherein each hollow columnar cell within the first row of the plurality of rows of the chambered honeycomb core is in vacuum communication with each adjacent hollow columnar cell within the first row via an aperture.

15. The media transport system of claim 12, wherein the platen further comprises a low friction coating disposed on an outer surface of the at least one face layer, wherein the low friction coating minimizes the friction between the face layer and the perforated belt.

16. The platen according to claim 11, wherein the chambered honeycomb core may have a height from about 3.175 mm to about 38.1 mm.

17. The platen according to claim 11, wherein the vertical walls forming the plurality of hollow columnar cells have a thickness from about 0.025 mm to about 4.0 mm.

18. The platen according to claim 11, wherein the chambered honeycomb core has a flatness of less than about 300 μm.

19. The platen according to claim 11, wherein from about 50% to about 97% by volume of the chambered honeycomb core is occupied by air.

* * * * *